United States Patent [19]

Heckman et al.

[11] 4,009,301

[45] Feb. 22, 1977

[54] METHOD FOR POWDER COATING

[75] Inventors: Russell W. Heckman, Perrysburg; Joseph S. Koluch, Northwood; Roger R. Rhoads, Toledo, all of Ohio

[73] Assignee: Owens-Illinois, Inc., Toledo, Ohio

[22] Filed: Sept. 5, 1974

[21] Appl. No.: 503,321

[52] U.S. Cl. ..... 427/195; 118/66; 118/308; 118/324; 118/503; 118/642; 427/29; 427/422

[51] Int. Cl.[2] ..... B44D 1/094

[58] Field of Search ..... 117/18, 20, 21, 94, 117/105.3, 105.4; 427/195, 185, 29, 422; 60/65 R, 65 A, 65 B, 65 D; 118/66, 308, 324, 503, 642

[56] References Cited

UNITED STATES PATENTS

| | | | |
|---|---|---|---|
| 3,226,245 | 12/1965 | Dettling et al. | 117/21 |
| 3,260,611 | 7/1966 | Weidenhammer et al. | 117/18 |
| 3,467,059 | 9/1969 | Korner et al. | 117/101 |
| 3,579,684 | 5/1971 | Duffy | 10/10 |
| 3,734,765 | 5/1973 | Russell et al. | 117/94 |
| 3,777,875 | 12/1973 | Sobran | 198/131 |
| 3,802,942 | 4/1974 | Amberg et al. | 156/86 |
| 3,805,985 | 4/1974 | Hagiwara et al. | 117/21 X |
| 3,828,729 | 8/1974 | Goodridge | 117/93.4 X |
| 3,856,498 | 12/1974 | Campagna et al. | 117/21 X |
| 3,860,104 | 1/1975 | Strauss | 198/179 |
| 3,895,126 | 7/1975 | Strauss et al. | 427/195 X |

*Primary Examiner*—Ronald H. Smith
*Assistant Examiner*—Shrive P. Beck
*Attorney, Agent, or Firm*—Steve M. McLary; Howard G. Bruss, Jr.; E. J. Holler

[57] ABSTRACT

A method for powder coating of articles with an organic polymeric material. Articles to be coated, preferably glass containers, are transported by a first conveying mechanism through a pre-heat oven wherein their temperature is raised to a level above ambient temperature. The preheated containers are then transferred to chucks of a second conveying mechanism which carry the containers through a powder spray apparatus wherein the organic polymeric material is applied to the container. The chucks of the second conveying mechanism are cool and any oversprayed material will not adhere thereto. After spraying, the containers are again heated to cure the sprayed-on powder coating to form a filmlike layer on the container. The containers are then cooled below the softening point of the organic polymeric material and released from the second conveying mechanism for further handling.

5 Claims, 7 Drawing Figures

METHOD FOR POWDER COATING

BACKGROUND OF THE INVENTION

This invention generally relates to a process for coating articles with a sprayed-on organic polymeric material in a powdered form. More particularly, this invention relates to such a process in which the articles are pre-heated before being coated. Specifically, this invention relates to such a process wherein the pre-heated articles are transferred to a cool conveying mechanism after being pre-heated to reduce the coating of the conveying mechanism with the material being sprayed on the article.

The technique of spraying organic polymeric material in a powdered form onto articles to thereby coat the articles is known in the art. Also known is pre-heating the article prior to spraying and heating the article after spraying to cure the material so applied. Glass containers in particular may be so coated to provide a fragment-retentive coating on the container in the event of breakage of the container. However, a recurring problem in so coating glass containers has been that of material build-up on chucks which carry the glass containers through the process. This results because the chucks become heated during the pre-heat procedure and any oversprayed material during the spray process melts on the hot chucks, thus tending to coat them. Within a rather short period of time, the chucks are so badly coated that their operation is impaired, and the process must be shut down for cleaning. We have found that glass containers may be preheated while being carried by one set of chucks and then transferred to a second set of cool chucks for transport through the spray apparatus. We can do this without losing alignment of the containers and without significant loss of pre-heat temperature. Any powder-sprayed material which does reach the cold chuck does not melt or adhere thereon, and may later be removed by any suitable means. This procedure significantly extends the time period between process shutdowns for cleaning purposes.

SUMMARY OF THE INVENTION

Our invention is a method for coating at least a portion of the exterior peripheral surface area of an article with an organic polymeric material in powdered form. The articles are loaded onto an endless moving conveyor at a loading zone. The articles are then conveyed through a heating apparatus to pre-heat the articles to a temperature above ambient temperature. The pre-heated articles are unloaded from the conveyor at an unloading zone spaced from the loading zone. The pre-heated articles are then loaded onto a second moving endless conveyor at a second loading zone adjacent the unloading zone. The articles are conveyed through a powder-spraying apparatus wherein they are sprayed with the organic polymeric material on the selected portions. Thereafter, the sprayed coating is cured during movement of the articles through a second heating apparatus along the second conveyor path. This is done by heating the powdered material sufficiently to flow the powder into a film-like coating on the article. Then, the coating is cooled to a temperature below its softening point while still on the second conveyor. Finally, the coated articles are unloaded from the second conveyor.

DETAILED DESCRIPTION OF THE DRAWINGS

Figure 1:
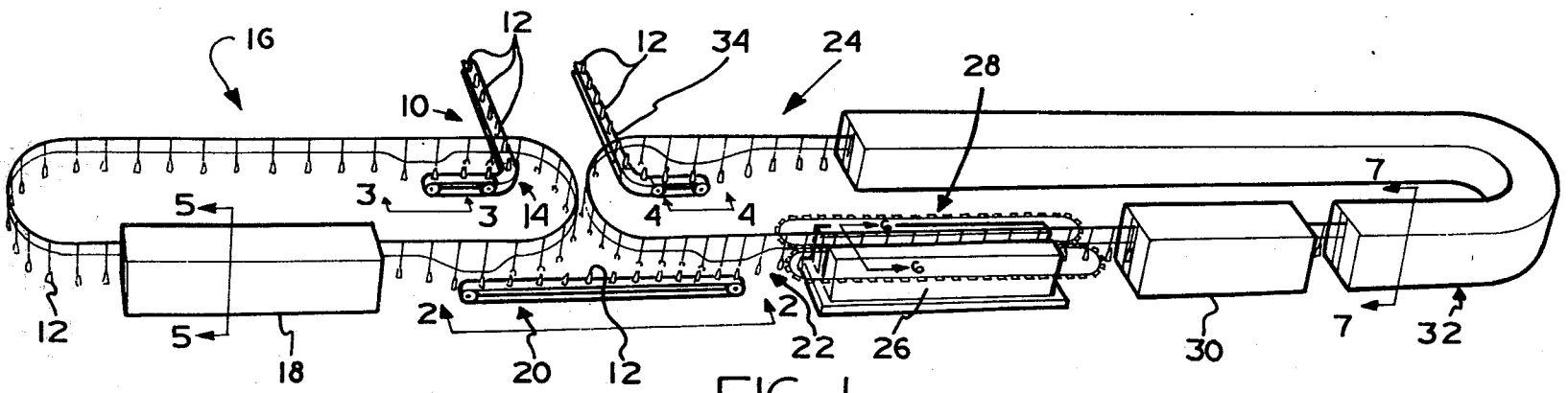
FIG. 1 is a schematic, perspective view of an apparatus for carrying out the method of the present invention.
Figure 5:
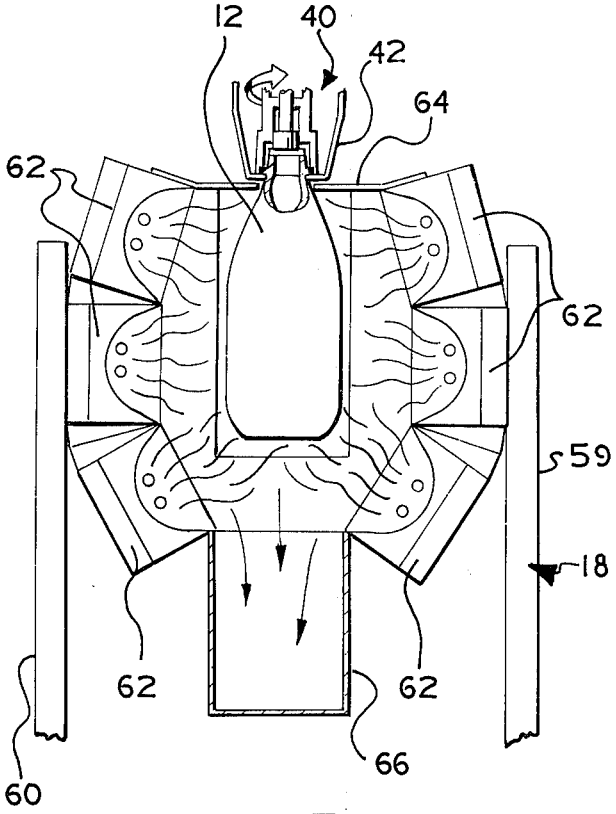
FIG. 5 is a cross sectional elevational view taken along the line 5—5 of FIG. 1.

FIG. 1 illustrates in a schematic form a machine for carrying out the method of the present invention. An infeed conveyor 10 presents a plurality of articles in a uniformly spaced-apart single file. For the purposes of giving a specific example, but not by way of limitation, these articles may be glass containers 12. The glass containers 12 are picked up at an input station generally designated as 14 and removed from the infeed conveyor 10 and transported by a first endless loop type of chain-conveying mechanism 16. The glass containers 12 are carried in an upright fashion by chucks of the chain-conveying mechanism 16. The glass containers 12 are gripped at their neck ends and supported in single file. This general type of mechanism is well known in the art and need not be explained in great detail to one skilled in the art of conveying articles. The chain-conveying mechanism 16 maintains the glass containers 12 in a single file and transports them through a pre-heating tunnel 18. In the pre-heating tunnel, the glass containers 12 are exposed to a high degree of heat and their temperature is raised from the ambient range of approximately 70° F. to a temperature of between 150° and 425° F. The glass containers 12, after exiting from the pre-heat tunnel 18, are unloaded from the mechanism 16 and deposited on an endless, moving intermediate transfer conveyor 20. The chain-conveying mechanism 16 releases the glass containers 12 onto the transfer conveyor 20 at an unloading zone along the loop of the mechanism 16 and over the conveyor 20. The glass containers 12 maintain their single file spacing on the transfer conveyor 20 as they are transported toward a pick-up zone in the path of travel of a second chain-conveying mechanism 24, generally designated as 22, where they are again grasped and removed from the transfer conveyor 20 by the second chaintype conveyor mechanism 24. This second chain-type conveyor mechanism 24 is substantially identical to the first mechanism 16. The mechanism 24 carries the glass containers 12 in an upright single file, their necks being grasped by chucks carried by the mechanism 24. The second chain-conveyor mechanism 24 transports the glass containers 12 in single file through a spraying tunnel 26. While passing through the spray tunnel, the glass containers 12 are coated with an organic polymeric material. This material is preferably applied in a powder form by an electrostatic type of spraying system. A preferred material may be a material known as Surlyn AD-5001, a product of the duPont Company. The Surlyn material is designed to coat the glass containers 12 with a coating in the range of 3 to 15 mils thick. It should be noted that the glass containers 12, when delivered to the transfer conveyor 20, have a temperature above ambient temperature. Glass containers tend to cool relatively slowly when heated, and thus enter the spray tunnel 26 at an elevated temperature. By transporting the glass containers 12 through the spray tunnel 26 in a heated condition, the powder spray material tends to partially fuse and flow during the transfer through the spray tunnel 26. The temperature of the glass containers at the exit from the spray tunnel 26 is elevated. While in the spray tunnel 26, the chucks which carry the glass containers 12 are shielded from the powder spray material by means of a movable mask assembly 28. This movable mask assembly is the subject of a co-pending patent application U.S. Ser. No. 372,974, filed June 25, 1973 now U.S. Pat. No. 3,886,899, issued June 3, 1975, having an assignee in common with the present invention. Reference is made to this co-pending patent application for further details of the operation of this moving mask assembly, and the teachings thereof are hereby incorporated by reference. One of the important aspects of the present invention is that the chucks which transport the glass containers 12 through the spray tunnel 26 are cool at the time they are transporting glass containers 12 through the spray tunnel 26. It will be recalled that the glass containers 12 were heated in pre-heating tunnel 18. By necessity, the chucks which carry the glass containers 12 also became heated during this process. However, the glass containers 12 were then released to the transfer conveyor 20 and the heated chucks then moved to pick up another series of glass containers 12 at the input or loading station 14. Thus the chucks on the second chain-conveying mechanism 24 were cool at the time they picked up the glass containers 12. Therefore, they transported heated glass containers to the spray tunnel 26, the heating of the glass containers 12 aiding in the adherence, deposition efficiency, and flow-out of the organic thermoplastic material which was sprayed in the spray tunnel 26. While the moving mask assembly 28 is quite effective in preventing the powder material from reaching the chuck, some material inescapably does reach the chucks which carry the glass containers 12. Since these chucks are relatively cool, the thermoplastic material, while having some tendency to stick onto these chucks, will not melt and adhere. This is important since if the chucks were hot, the thermoplastic material would tend to melt and over a period of time would coat the chucks thus making it very difficult for this apparatus to operate properly. After leaving the spray tunnel 26, the second chain-conveyor mechanism 24 transports the glass containers 12 through a curing oven 30. FIG. 5 illustrates the curing oven 30 in greater detail. In the curing oven 30, the carrying chucks are partially shielded from the heat therein to prevent any flow-out or fusion of any power which reached the cold chucks during the spray process in the spray tunnel 26. The curing oven 30 then raises the temperature of the coating placed on the glass containers 12 to the range of 400° to 425° F. This temperature is found to be an optimum temperature for curing the Surlyn material previously mentioned as a preferred material for the operation of this process. However, other temperature ranges could be required for other organic polymeric materials. The curing oven 30 completes the flow-out of the Surlyn powder material put on during the spray process in the spray tunnel 26 forming a film-like coating that is of a relatively smooth texture. This heating further allows the material to be completely flowed out. After exiting from the curing oven 30, the glass containers 12 are transported through a cooling section 32. The cooling section 32 directs pressurized cooling media, preferably air, onto the surface of the glass containers 12 and cools the coating thereon to a temperature which allows safe handling. At the exit of the cooling section 32, the temperature of the glass container and its coating is approximately 150° F. At this temperature, the organic polymeric coating is sufficiently set up so that it will not mar or run if it is placed on a solid surface. Thus, as the glass containers 12 exit from the cooling section 32, they pass through an unloading zone where they are deposited by the second chainconveyor mechanism 24 onto an output conveyor 34 for removal from this process and further handling.

Figure 2:
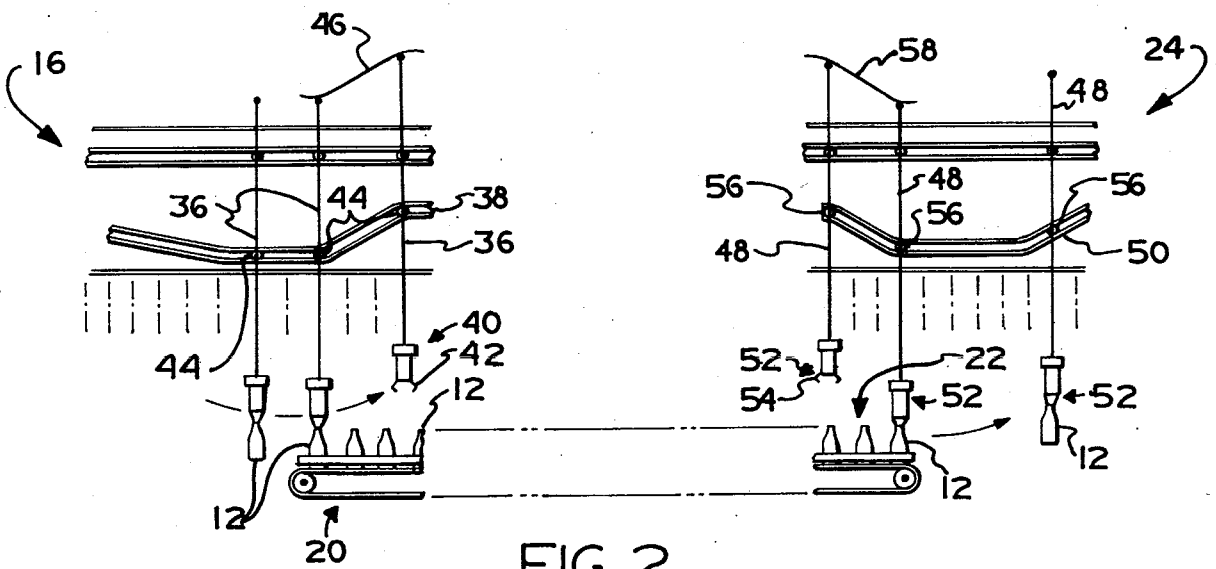
FIG. 2 is a side elevational view of a portion of the apparatus of FIG. 1 designated by the line 2—2 of FIG. 1.

FIG. 2 illustrates in a schematic form the deposit of glass containers 12 onto the transfer conveyor 20 and their subsequent pick-up or transport through the spray tunnel 26. The first chain-conveying mechanism 16 is primarily comprised of a plurality of main spindle members 36 which are all linked together in an endless chain around a closed loop. Not all of the main spindle members 36 are shown in FIG. 2, but their positions are indicated by a center line marking. The main spindles 36 are vertically movable under the control of a positional cam 38. Each of the main spindles 36 carries on its end a grasping means or chuck 40 which includes tong members 42 for grasping and transporting the glass containers 12. Each of the main spindles 36 has associated therewith a cam follower 44 which is constrained to track within the positional cam 38. The cam followers 44 are attached to the main spindles 36 so that the main spindles' 36 position is determined by the position of its associated cam follower 44. Note that as the glass containers 12 approach the transfer conveyor 20 in FIG. 2, the positional cam 38 is declining in elevation to bring the bottom portion of the glass container 12 into the same elevation as that of the transfer conveyor 20. The transfer conveyor 20 is moving at a velocity which is substantially equal to the velocity of the first chain-conveying mechanism 16 so that the glass container 12 is smoothly brought into contact with the surface of the transfer conveyor 20. At this point, the tong members 42 are opened by engagement with a tong opening cam 46. The tong members 42 are normally biased into a closed position and must be opened by a contact with the tong opening cam 46. Also at this point, the positional cam 38 begins to rise again and thus raises the grasping means 40 and the tong members 42 completely away from the glass containers 12. Then, these particular grasping means 40 and tong members 42 are brought around the end of the first chain-conveying mechanism 16 back to the input station 14 to pick up additional glass containers 12. The glass containers 12 then proceed on the transfer conveyor 20 maintaining their single file spacing until such time as they are picked up by the second chain-conveyor mechanism 24. The second chain-conveyor mechanism 24 is substantially identical to the first chain-conveyor mechanism 16. There are a plurality of main spindles 48 whose vertical position is controlled by a positional control cam 50. Each of the main spindles 48 carries a grasping means or chuck 52 which includes carrying tong members 54. The actual position of the main spindles 48 is determined by a cam follower 56 attached to each of the main spindles 48 which tracks or is controlled by the shape of the positional control cam 50. In the pick-up area 22, the positional control cam 50 is shaped to lower the grasping means 52 into general contact with the glass containers 12 as they pass by in their single file spaced-apart array. At this point, it is necessary to open the tong members 54 which are normally biased closed. This function is performed by a tong opening cam 58. The tong opening cam 58 opens the tong members 54 while the grasping means 52 are simultaneously lowered into contact with the glass containers 12. When the tong members 54 are fully in contact with the glass containers 12, the tong opening cam 58 ceases and the tong members close to pick up the glass containers 12. At this point, the glass containers 12 may be moved off of the transfer conveyor 20 in a smooth, even pattern without any transfer shock. The positional control cam 50 may then rise slightly to bring the glass containers 12 to a preferred elevation for treatment or coating within the spray tunnel 26. Note that this entire operation is performed primarily to ensure that the grasping means 52 and the tong members 54 are cool when the glass containers 12 are transported through the spray tunnel 26. As was previously explained, if the same grasping means and tong members were used to transport the glass containers 12 through both the pre-heating tunnel 18 and the spray tunnel 26, the tong members and grasping means themselves would be heated and would be subject to coating by the material sprayed within the spray tunnel 26.

Figure 3:
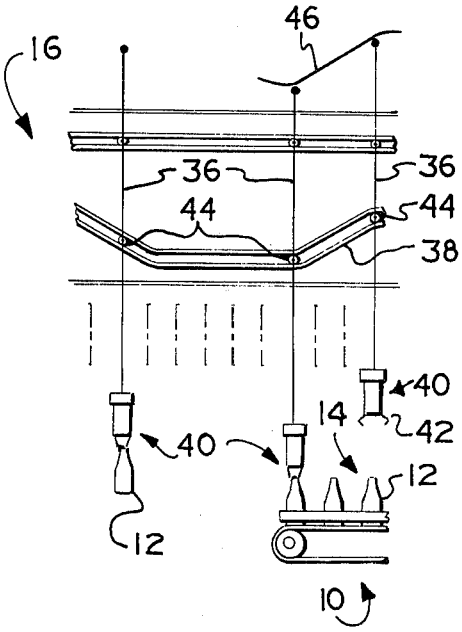
FIG. 3 is a side elevational view taken along the line 3—3 of FIG. 1.
Figure 4:
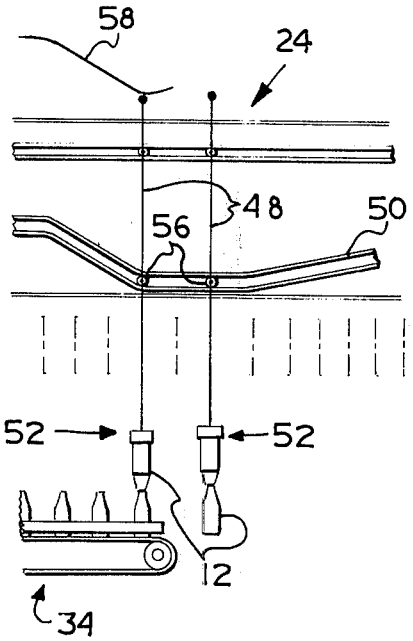
FIG. 4 is a side elevational view taken along the line 4—4 of FIG. 1.

FIG. 3 illustrates the pick-up of the glass containers 12 at the input station 14. This is an operation which is substantially identical to that operation performed at the pick-up area 22 on the transfer conveyor 20. FIG. 4 illustrates the delivery of glass containers 12 from the second chain-conveying mechanism 24 onto the output conveyor 34. This operation may be seen to be substantially identical to that performed by the first chain-conveyor mechanism 16 at the point at which the first chain-conveyor mechanism 16 delivers the glass containers 12 to the transfer conveyor 20.

FIG. 5 is a cross sectional view taken through the pre-heating tunnel 18. The pre-heating tunnel 18 and the curing oven 30 are substantially identical in configuration and thus the cross sectional view of FIG. 5 could be considered to be a cross sectional view through either one of these two heating devices. The basic purpose in both cases is to controllably heat the glass container. The pre-heating tunnel 18 has two main sidewall panels 59 and 60. The pre-heating tunnel 18 is lined on both sides along its length with a plurality of heating elements 62. The heating elements 62 are preferably gas-fired infra-red burners which provide a maximum of radiant energy that is readily absorbed by a glass container 12 passing through the pre-heating tunnel 18 to provide for maximum heating efficiency of the glass container 12. The heating elements 62 are preferably angled slightly so that all areas of the glass container 12 passing through the preheating tunnel 18 are exposed to the same degree of radiant heat energy. Of course, there is some convective heating present from the hot air currents set up within the preheating tunnel 18. The top of the pre-heating tunnel is sealed off with a top cover plate 64 which substantially serves to define a closed space for the pre-heating tunnel 18. The cover plate 64, in the curing oven 30, also helps prevent heating of the grasping means 52 as a further means of preventing any material thereon from melting or fusing thereto. An exhaust duct 66 serves to exhaust heated air from the preheating tunnel 18 to ensure that the interior of the preheating tunnel does not become too hot. Note that the arrow in FIG. 5 illustrates that it is possible to rotate the glass containers 12 while it is passing through the pre-heating tunnel 18. This is desirable to ensure that the glass container 12 is uniformly heated about its entire peripheral area during its passage through the pre-heating tunnel 18. This rotation is also available in the curing oven 30.

Figure 6:
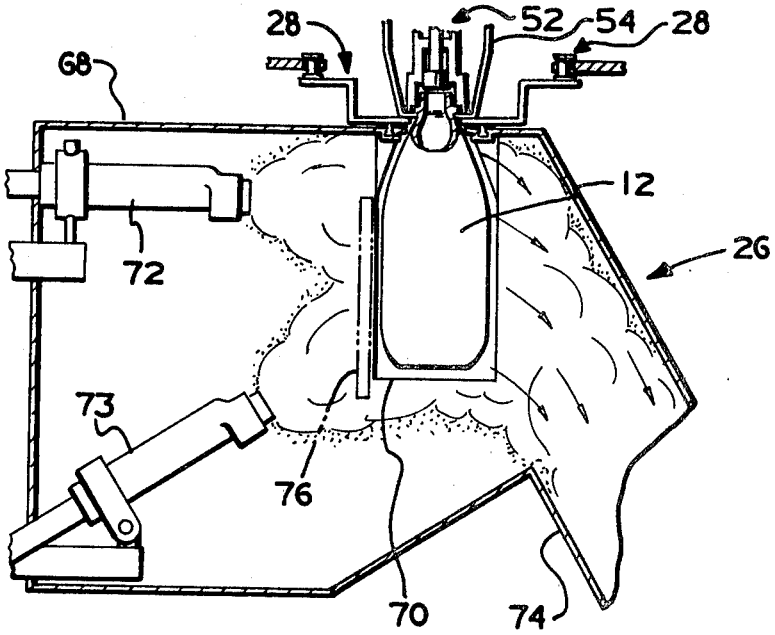
FIG. 6 is a cross sectional elevational view taken along the line 6—6 of FIG. 1.

FIG. 6 illustrates a cross sectional view of the spray tunnel 26. The spray tunnel 26 is primarily made up of a total sheet metal enclosure 68. The sheet metal enclosure 68 has an inlet opening 70 through which the glass container 12 may pass to enter the spray tunnel 26 and a corresponding outlet opening which is not shown. Positioned within the spray tunnel 26 are the spray guns which apply the organic thermoplastic coating to the glass container 12. In this example, two spray guns 72 and 73 are shown. The spray guns 72 and 73 are inserted through openings in the sheet metal enclosure 68. The spray guns 72 and 73 are preferably of the electrostatic type which will spray powders of the organic polymeric material which forms the coating on the glass container 12. Note that the spray gun 73 is located near the bottom of the sheet metal enclosure 68 and pointed upward toward the glass container 12. This positioning of the spray gun 73 allows a uniform coating of the lower portion of the glass container 12. If desired, the glass container 12 may be rotated while it passes through the spray tunnel 26. The spray tunnel 26 also includes an exhaust duct portion 74 which allows removal of excess material that is sprayed by the two spray guns 72 and 73. The exhaust duct 74 is connected to an exhaust blower which is not shown which generates sufficient pressure to pull excess material from within the sheet metal enclosure 68. One aspect of this process is that only a selected portion of the glass container may be coated within the spray tunnel 26 if desired. To accomplish this, a baffle member 76, shown in phantom lines, in FIG. 6 may be inserted. The actual view of FIG. 6 illustrates both the spray gun 72 and 73 projecting material toward the glass container 12 to allow total coating of the glass container 12. However, the baffle member 76 may be raised into place to block the lower portion of the glass container 12 from contact with material which is sprayed toward the glass container 12. In this situation, the spray gun 73 would be left inoperative, and only the spray gun 72 would be projecting material toward the glass container 12. This would allow coating of, for example, only the shoulder portion of the glass container 12. The baffle member 76 is preferably made of a non-electrically conductive material such as plywood or a pressed wood material. This is necessary since, as was noted earlier, the spray gun 72 is preferably of the electrostatic type. By making the baffle member 76 of a non-electrically conducting material, the electrostatically charged material sprayed by the spray gun 72 will not have a tendency to stick to the baffle member 76.

Figure 7:
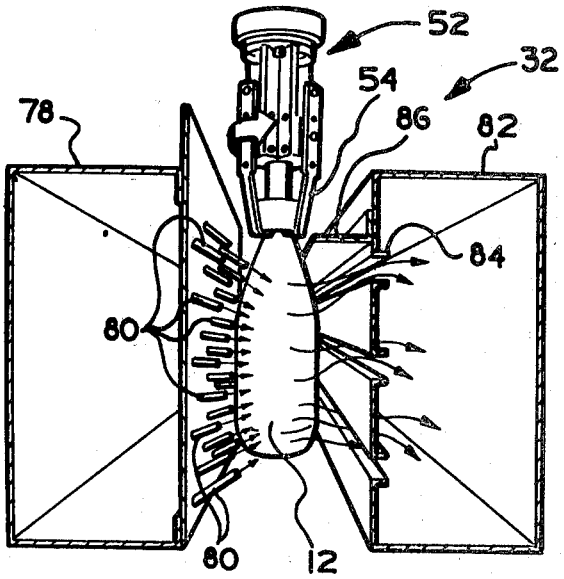
FIG. 7 is a cross sectional view taken along the line 7—7 of FIG. 1.

In FIG. 7, it may be seen that the cooling section 32 is actually made up of two separate portions. First of all, there is a plenum chamber portion 78. A relatively high velocity air stream is presented in the plenum chamber 78 to allow rapid cooling of glass containers 12 after their passage through the curing oven 30. This is preferably air which exits at a velocity of from 4,000 to 6,000 feet per minute onto the now coated glass container 12 to allow final set-up of the organic polymeric coating placed thereon. A plurality of nozzles 80 are connected to the interior of the plenum chamber 78 and direct air streams onto the glass container 12. As the arrow in FIG. 7 shows, the glass container 12 is preferably rotated by the grasping means 52 during its passage through the entire cooling section 32. To ensure a complete sweep and to remove heated air from the cooling section 32, an exhaust chamber 82 is formed on the opposite side of the glass container 12 from the plenum chamber 78. The exhaust chamber 82 and the plenum chamber 78 make up the primary components of the cooling section 32. The gas which is blown from the nozzles 80 is pulled into the exhaust chamber 82 through a plurality of slits 84 formed in the wall of the exhaust chamber 82 adjacent to the glass container 12. The exhaust chamber 82 is connected to a suitable exhaust fan which creates a pressure differential in the exhaust chamber 82 which pulls the heated air into the exhaust chamber 82. A baffle member 86 extends outward almost into contact with the glass container 12 to help further direct the sweep of the cooling air from the nozzles 80 into the exhaust chamber 82.

We claim:

1. The method of coating at least a selected portion of the external peripheral surface area of containers with an organic polymeric material in powdered form which comprises the steps of:

conveying the containers through a preheating zone, for increasing the temperature of said containers to a temperature of at least 150° F., in an upright position grasped at their upper end by chucks carried by a first chuck carrying conveyor;

completely releasing said containers from said first chuck carrying conveyor and simultaneously therewith;

depositing said heated containers on a moving transfer conveyor at an unloading zone;

transporting said heated containers in a spacedapart single file on said transfer conveyor to a loading zone remote from said unloading zone;

moving the chucks of a second chuck carrying conveyor into general registry with said loading zone;

grasping, at said loading zone, each of the preheated containers with a chuck, substantially lower in temperature than the container temperature, of said second chuck carrying conveyor;

removing said containers from said transfer conveyor by the continued movement of said second chuck carrying conveyor;

conveying the preheated containers through a powder spraying apparatus;

spraying said powdered organic polymeric material onto the selected portion of said preheated containers during their movement through said spraying apparatus; and thereafter curing said sprayed organic polymeric material on said containers so as to produce a film-like organic polymeric layer overlying said selected portion thereof.

2. The method of claim 1 which includes the further step of:

masking said second chucks while said containers travel through said spraying apparatus to prevent overspray of said organic polymeric material onto said second chucks.

3. The method of claim 1 which includes the further step of:

rotating said containers about their vertical axis during movement through said pre-heating zone.

4. The method of claim 1 which includes the further step of:

rotating said containers about their vertical axis during travel through said powder-spraying apparatus.

5. The method of claim 1 which includes the further step of:

rotating said containers about their vertical axis during the curing of said sprayed-on organic polymeric material.

* * * * *